US009737186B2

(12) United States Patent
DeGeorge

(10) Patent No.: US 9,737,186 B2
(45) Date of Patent: Aug. 22, 2017

(54) APPARATUS AND METHOD FOR DETECTING MATERIALS

(71) Applicant: Michael DeGeorge, Middletown, NJ (US)

(72) Inventor: Michael DeGeorge, Middletown, NJ (US)

( * ) Notice: Subject to any disclaimer, the term of this patent is extended or adjusted under 35 U.S.C. 154(b) by 165 days.

(21) Appl. No.: 14/275,242

(22) Filed: May 12, 2014

(65) Prior Publication Data

US 2014/0246512 A1 Sep. 4, 2014

Related U.S. Application Data

(63) Continuation-in-part of application No. PCT/US2012/064138, filed on Nov. 8, 2012.

(60) Provisional application No. 61/837,961, filed on Jun. 21, 2013, provisional application No. 61/558,562, filed on Nov. 11, 2011.

(51) Int. Cl.

| | |
|---|---|
| ***B05B 7/02*** | (2006.01) |
| ***B05B 9/01*** | (2006.01) |
| ***A47L 11/00*** | (2006.01) |
| ***F21V 33/00*** | (2006.01) |
| ***F21V 21/08*** | (2006.01) |
| *F21V 23/04* | (2006.01) |
| *B05B 11/00* | (2006.01) |
| *F21Y 113/10* | (2016.01) |

(52) U.S. Cl.

CPC ..... *A47L 11/00* (2013.01); *F21V 21/0832* (2013.01); *F21V 33/0004* (2013.01); *B05B 11/30* (2013.01); *F21V 23/04* (2013.01); *F21Y 2113/10* (2016.08)

(58) Field of Classification Search

CPC .... A47L 11/00; F21V 21/0832; F21V 33/004; F21V 23/04; F21Y 2113/002; B05B 11/30

USPC ..... 239/526, 525, 302, 327, 337, 375, 378

See application file for complete search history.

(56) References Cited

U.S. PATENT DOCUMENTS

| | | | | |
|---|---|---|---|---|
| 3,784,804 | A | 1/1974 | Sabatelli et al. | |
| 4,291,839 | A | 9/1981 | Brett | |
| 4,912,750 | A | 3/1990 | Foster | |
| 5,124,892 | A * | 6/1992 | Lambert | B64D 11/00 362/103 |
| 5,279,256 | A | 1/1994 | Brite | |
| 6,082,872 | A * | 7/2000 | Ting | F21L 4/00 362/191 |

(Continued)

FOREIGN PATENT DOCUMENTS

| | | | |
|---|---|---|---|
| JP | 2005304599 | A | 4/2005 |
| JP | 2005152711 | A | 6/2005 |

OTHER PUBLICATIONS

International Search Report for corresponding PCT Application No. PCT/US2012/064138, mailed Mar. 27, 2013.

(Continued)

*Primary Examiner* — Justin Jonaitis

(74) *Attorney, Agent, or Firm* — Myers Wolin, LLC

(57) ABSTRACT

A nozzle comprising a first light and a second light, wherein one of the lights is used to detect certain materials, such as bodily fluids, pet messes and stains and the like, while the other light is used for illuminating an area to be cleaned. The lights may be integrally incorporate into a nozzle or removably detachable therefrom.

17 Claims, 8 Drawing Sheets

(56) References Cited

U.S. PATENT DOCUMENTS

| | | | | |
|---|---|---|---|---|
| 6,182,911 | B1 * | 2/2001 | Hanks | B01F 5/0077 239/318 |
| 6,676,270 | B2 | 1/2004 | Kostal et al. | |
| 6,896,192 | B2 | 5/2005 | Horan et al. | |
| 7,121,432 | B2 | 10/2006 | Kostal et al. | |
| 7,264,143 | B2 * | 9/2007 | Khubani | B65D 83/384 222/182 |
| 7,703,937 | B2 * | 4/2010 | Shirey | A44C 9/0053 362/103 |
| 8,975,606 | B2 * | 3/2015 | Bowers | F21L 4/00 250/504 R |
| 2003/0131426 | A1 | 7/2003 | Schulling | |
| 2006/0007669 | A1 * | 1/2006 | Blackburn | A41D 19/0157 362/103 |
| 2010/0096472 | A1 * | 4/2010 | Klein, II | B05B 12/004 239/73 |
| 2010/0213212 | A1 | 8/2010 | Custodis et al. | |
| 2010/0276514 | A1 * | 11/2010 | Stethem | F41B 15/04 239/289 |
| 2011/0050123 | A1 * | 3/2011 | Duerr | F21V 21/084 315/294 |
| 2012/0298776 | A1 * | 11/2012 | Yu | F41H 9/10 239/311 |

OTHER PUBLICATIONS

"Hurricane Pepper w/LED Light", online: www.Knives4Wholesale.com, accessed on Sep. 26, 2011.

Davies, "Glow Graffiti lets you tag with UV light", online: www.Slashgear.com, Dec. 30, 2008.

"Urine-Gone!", online: www.ThisNext.com, accessed on Sep. 26, 2011.

"Urine-Off Dog & Puppy 500ml Spray W/LED Urine Finder", online: www.TheCheckpointCleaningStore.com, accessed on Sep. 26, 2011.

* cited by examiner

APPARATUS AND METHOD FOR DETECTING MATERIALS

CROSS REFERENCE TO RELATED APPLICATIONS

The present application is a continuation of U.S. Application No. 61/837,961, filed Jun. 21, 2013, and a continuation in part of International Application No. PCT/US12/64138, filed on Nov. 8, 2012, which claims priority to U.S. Application No. 61/558,562, filed Nov. 11, 2011, the contents of each of which are incorporated herein by reference.

FIELD OF THE INVENTION

The invention pertains generally to detecting materials that fluoresce or glow under the presence of ultraviolet light, such as pet stains, bodily fluids (i.e., blood, urine, semen, etc.), and more specifically, to an apparatus and method for incorporating a light onto a fluid remover for identifying and detecting a material to be removed or cleaned.

BACKGROUND

A variety of materials are known to fluoresce or glow under the presence of ultraviolet or black light. These include, but are not limited to, bodily fluids such as blood, urine and semen, as well as petroleum jelly, tonic water, vitamins, chlorophyll, antifreeze, laundry detergent, liquid cleaners, tooth whiteners, etc. In addition, other materials are capable of being revealed under light that is other than white light. In the field of forensics, for example, it is well known to use a black light at a crime scene to detect semen, blood and other materials. In a household, for example, it is popular to use black light to detect pet stains, for it is well known that many pet owners experience problems and difficulty when attempting to identify, detect, and remove pet urine and fecal matter from surface areas.

According to the American Veterinary Medical Association, about 63 percent of all households in the United States have a pet. As of 2011, about 75 million dogs and about 85 million cats are owned in the United States (Source: Pet Food Institute). Many of these pets live inside the house with the pet owner. While pets are ideally trained to urinate or defecate either outdoors or in a specific area such as a litter box, not all pets are housebroken in such a manner. Furthermore, pets sometimes do make mistakes and/or get sick such that they eliminate indoors on a non-desirable surface area such as on a fancy rug, on a carpet, or on a wood floor. If untreated, the pet urine and fecal matter may result in a permanent stain on the flooring material. It is well known that pet urine and fecal matter and their related odors are not wanted. Furthermore, such pet odors may be embarrassing to the home owner.

Current methods for removing pet stains from surface areas include commercially available products such as "Urine Gone!" and "Urine-Off" odor and stain removers. Each of these products appears to include a spray bottle containing a cleaning solution with certain enzymes to react with the pet stain, and a separate source of black light (e.g. a separate flashlight) which allegedly detects and identifies the stains to be removed.

One problem with the method of using a spray bottle and a black light flashlight is that the bottle and the flashlight are two distinct units which can easily be separated from each other. For example, it is not difficult to imagine a homeowner who places the flashlight in a different location from the spray bottle. In the event that the flashlight becomes lost or misplaced, the homeowner will have to estimate the specific location of the pet stain without the use of the flashlight, thereby defeating its purpose.

Another problem with having the bottle and the flashlight as two distinct units occurs when a pet owner uses the flashlight to locate the pet stain but fails to apply a marker on the surface area to be cleaned to pinpoint the exact location of the stain. When the pet owner retrieves the spray bottle to apply the cleaning enzyme to the stain, the pet owner may lose the specific location of the stain, thereby forcing a repeat of the process of locating the pet stain.

Furthermore, a separate hand is required to operate each of the black light flashlight and the spray bottle. This can make it awkward and clumsy to clean up a pet mess and to remove the pet stain because a third hand is needed to carry a cloth or paper towel that is required to wipe off and absorb the solution and the mess.

In addition, in case a non-black light (e.g. a white light) is needed in the process of detecting and removing the pet mess stain, the prior art needs to rely on an additional, separate, second light source.

SUMMARY

The present disclosure includes various embodiments for identifying a target material, such as a pet stain, for example, and for applying a cleaning fluid to clean the target material. In one embodiment, there is provided a dispenser nozzle comprising a first light and a second light, wherein one of the lights is used to detect a fluid or stain or the like, while the other light is used for illuminating an area to be cleaned. The lights may be integrally incorporated into a nozzle or removably detachable therefrom. In a preferred embodiment, one of the lights is a white light while one of the lights is other than a white light, such as an ultraviolet or black light. This arrangement makes it possible to simultaneously detect and apply a cleaning material for removing the target fluid from the surface to be cleaned.

A more detailed explanation of the invention is provided in the following description and claims, and is illustrated in the accompanying drawings.

DETAILED DESCRIPTION OF THE PREFERRED EMBODIMENTS

Figure 1:
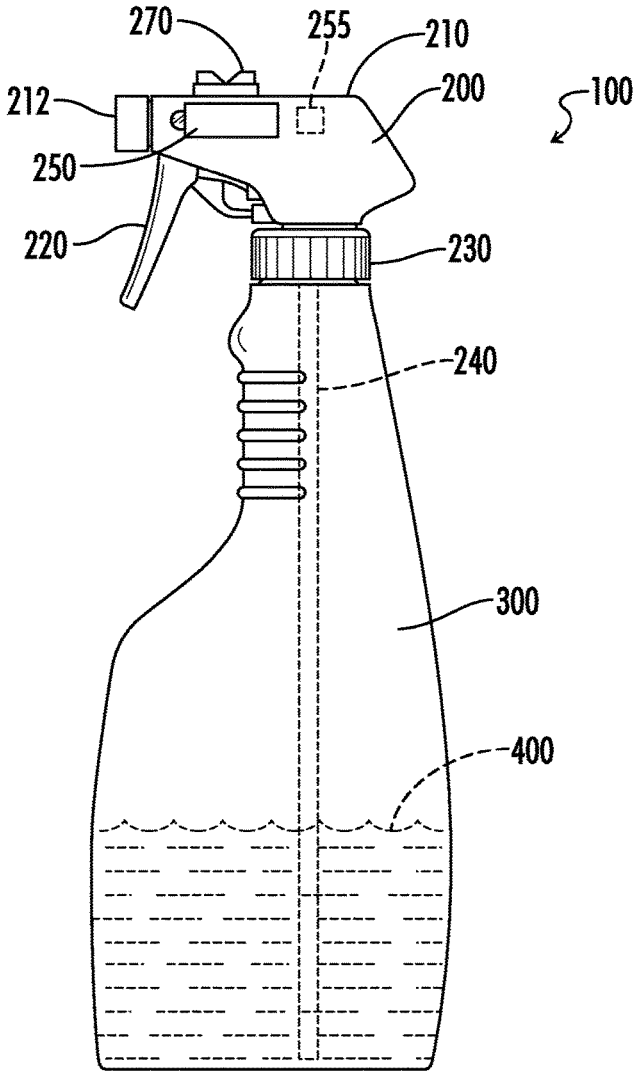
FIG. 1 illustrates a side elevation of one embodiment of a dispenser of the present disclosure.

The description of illustrative embodiments according to principles of the present invention is intended to be read in connection with the accompanying drawings, which are to be considered part of the entire written description. In the description of embodiments of the invention disclosed herein, any reference to direction or orientation is merely intended for convenience of description and is not intended in any way to limit the scope of the present invention. Relative terms such as "lower," "upper," "horizontal," "vertical," "above," "below," "up," "down," "top" and "bottom" as well as derivative thereof (e.g., "horizontally," "downwardly," "upwardly," etc.) should be construed to refer to the orientation as then described or as shown in the drawing under discussion. These relative terms are for convenience of description only and do not require that the apparatus be constructed or operated in a particular orientation unless explicitly indicated as such. Terms such as "attached," "affixed," "connected," "coupled," "interconnected," and similar refer to a relationship wherein structures are secured or attached to one another either directly or indirectly through intervening structures, as well as both movable or rigid attachments or relationships, unless expressly described otherwise. Moreover, the features and benefits of the invention are illustrated by reference to the exemplified embodiments. Accordingly, the invention expressly should not be limited to such exemplary embodiments illustrating some possible non-limiting combination of features that may exist alone or in other combinations of features; the scope of the invention being defined by the claims appended hereto.

This disclosure describes the best mode or modes of practicing the invention as presently contemplated. This description is not intended to be understood in a limiting sense, but provides an example of the invention presented solely for illustrative purposes by reference to the accompanying drawings to advise one of ordinary skill in the art of the advantages and construction of the invention. In the various views of the drawings, like reference characters designate like or similar parts.

This disclosure describes certain embodiments for use in connection with the removal of a pet stain from a surface. However, it will be realized that the principles and aspects of the present invention can be applied to other environments, such as where it is desired to detect other fluids or materials that might be revealed by certain special lights, or such as where it is desired to detect materials in settings other than a home setting, such as at a crime scene, in a laboratory environment, or the like. Furthermore, while certain embodiments are described in connection with the detection and/or cleaning of pet stains, it will be appreciated that other materials may be targeted including, but not limited to, bodily fluids such as blood, urine and semen, as well as petroleum jelly, tonic water, vitamins, chlorophyll, antifreeze, laundry detergent, liquid cleaners, tooth whiteners, etc. In addition, other materials are capable of being revealed under light that is other than white light. For purposes of explanation and convenience, the following disclosure will explaining the targeting and cleaning of pet stains as an example, it being appreciated that the invention is not to be limited to such example.

FIG. 1 illustrates one embodiment of a dispenser 100 including a spray nozzle 200 connected to a reservoir 300 that would contain a cleaning medium 400 such as a liquid cleaner 400 or the like. The cleaning medium 400 in this embodiment is preferably formulated to eliminate pet stains and odors, and may incorporate special enzymes, deodorants, and the like, although other cleaning mediums formulated to clean other target fluids are possible. While each element is shown in the drawings with a certain shape and configuration, it will be appreciated that other configurations and constructions are possible. For example, while a trigger-based spray nozzle 200 is shown, it will be appreciated that a push-button-activated trigger may be used. Similarly, while a rounded reservoir 300 is shown, it will be appreciated that other shaped reservoirs may be used. Other configurations are possible.

Figure 2:
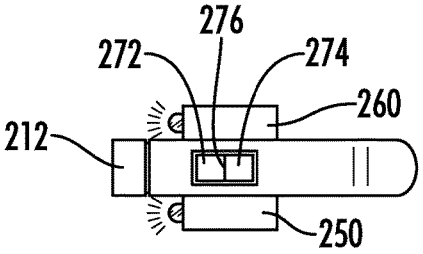
FIG. 2 illustrates a top view of the dispenser of FIG. 1.
Figure 3:
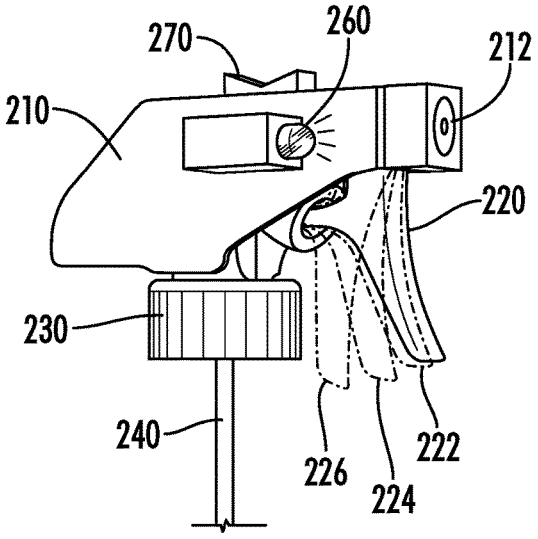
FIG. 3 illustrates an embodiment of the dispenser nozzle of FIG. 1.

FIGS. 2 and 3 illustrate a top view and a side view respectively of one embodiment of the spray nozzle 200 of FIG. 1 shown disconnected from the reservoir 300. The spray nozzle 200 in the embodiment of FIGS. 1 and 2 further comprises a body 210 including an outlet 212, a squeeze trigger 220 attached to the body 210 for activating the spraying or dispensing of the cleaning medium 400 through the outlet 212 and onto a surface, a collar 230 for attaching the nozzle 200 to the reservoir 300, and a tube 240 for withdrawing cleaner 400 (FIG. 1) from the reservoir 300 for dispensing through the outlet 212. The nozzle body 210 further comprises a first light 250 and a second light 260 that is spaced from the first light 250. The spacing of the first light 250 from the second light 260 is arranged so that the lights 250 and 260 do not interfere with each other when they are both activated. In the illustrated embodiment, the lights 250 and 260 are preferably on opposite sides of the outlet 212, although they may be alternately positioned as desired, and such lights 250 and 260 are preferably fixed to the body 210, although such lights may be directable (orientable) as desired. Also, while two lights are shown, alternatives are possible, including the use of only one light, or more than two lights (not shown). The lights may be incandescent, halogen, LED (light emitting diodes), or any other technology now known or hereinafter developed, and are preferably powered by a power source 255 (FIG. 1) provided in the body 210 or elsewhere on the dispenser 100.

Each of the lights 250 and 260 may be operated by separate switches (not shown), or by a single slide switch, or by a single toggle switch 270 that has three positions, where the first position 272 illuminates the first light 250, the second position 274 illuminates the second light 260, and the third position 276 is off. The lights 250 and 260 may also be operated using the trigger 220 where, for example, a partial activation or first initial movement 222 of the trigger 220 illuminates the first light 250, a further partial activation or movement 224 of the trigger 220 illuminates the second light 260, and a third complete activation or movement 226 of the trigger 220 is used to dispense cleaner 400 through the outlet 212, where the third movement 226 is capable of being repeated for dispensing without having to cycle through the first two movements 222 and 224 and through the lights 250 and 260. In a preferred embodiment, one of the lights remains on during the third movement 226 of the trigger 220, i.e., during the dispensing of cleaner 400 through the outlet 212.

In a preferred arrangement, the second light 260 is a white light for illuminating an area to be cleaned, and the first light 250 is other than a white light, such as an ultraviolet light, for example, for use in detecting and identifying pet mess stains on a surface such as a floor, carpeting or the like. When a "white light" is referenced herein, it will be understood that such a term refers to light from a wide variety of polychromatic light sources that generate a light that appears approximately white to the eye. The first light 250 is typically used without the second light 260 to identify the area of concern, although both lights can be used at the same time if desired. Also, while one light is a white light and the other light is not a white light, it will be appreciated that both lights can be interchanged as desired. In addition, either or both lights might have varying intensities that may be controlled by additional switches or the like (not shown).

Various operations are contemplated for enabling a user to simultaneously identify/detect and clean a pet mess or stain. In one embodiment, a user would activate the first light 250 to identify the pet mess and simultaneously dispense cleaning solution 400 during the activation of the first light 250. In an alternative embodiment, a user would activate the first light 250 to identify the pet mess and dispense cleaning solution 400 during the activation of the first light 250, and then use the second light 260 to further illuminate the area during scrubbing, cleaning and the like, while the first light 250 is also activated to continue highlighting the stain. In an alternative embodiment, the user would only activate the second light 260 during cleaning/scrubbing of the area of concern. Other methods of operation are possible.

Figure 4:
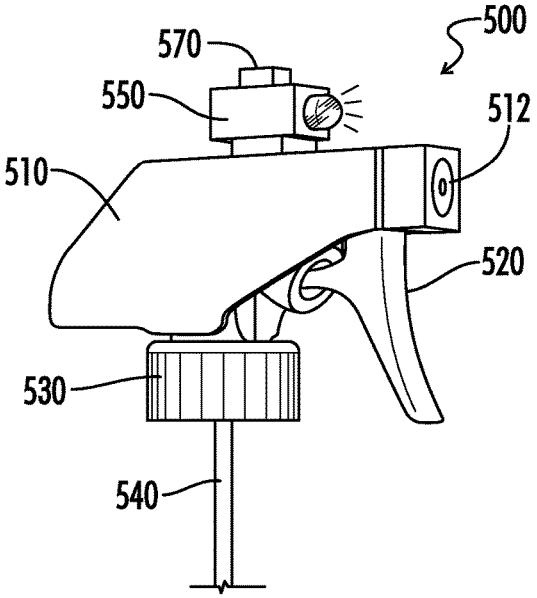
FIG. 4 illustrates an alternate embodiment of a dispenser nozzle.

FIG. 4 illustrates a side view of an alternative embodiment of a spray nozzle 500 for use with a container (not shown), the spray nozzle 500 further comprising a body 510 including an outlet 512, a squeeze trigger 520 attached to the body 510 for activating the spraying or dispensing of cleaning medium through the outlet 512 and onto a surface, a collar 530 for attaching the nozzle 500 to a reservoir (not shown), and a tube 540 for withdrawing cleaner from the reservoir for dispensing through the outlet 512. The body 510 further comprises a single light body 550 operated by a switch 570 that either emits one type of light, such as a white light or a non-white light, or that can emit multiple types of light depending on the position of the switch 570. In a preferred embodiment, the orientation of the light 550 is such that the beam of light that is produced is in alignment with the outlet 512 of the spray nozzle 500. For example, the focal point of the light is arranged to be the same as the area where the spray of cleaning medium is propelled. This way, the user can focus the light on the pet stain and then immediately squeeze the trigger 520 to apply the cleaning fluid on the stain. In this embodiment, the user can detect and apply the cleaning fluid simultaneously with one hand. The other hand can be used, for example, to hold a cloth or rag (not shown) to wipe up the cleaning solution. The body 550 may be capable of being directed by a user.

Figure 5:
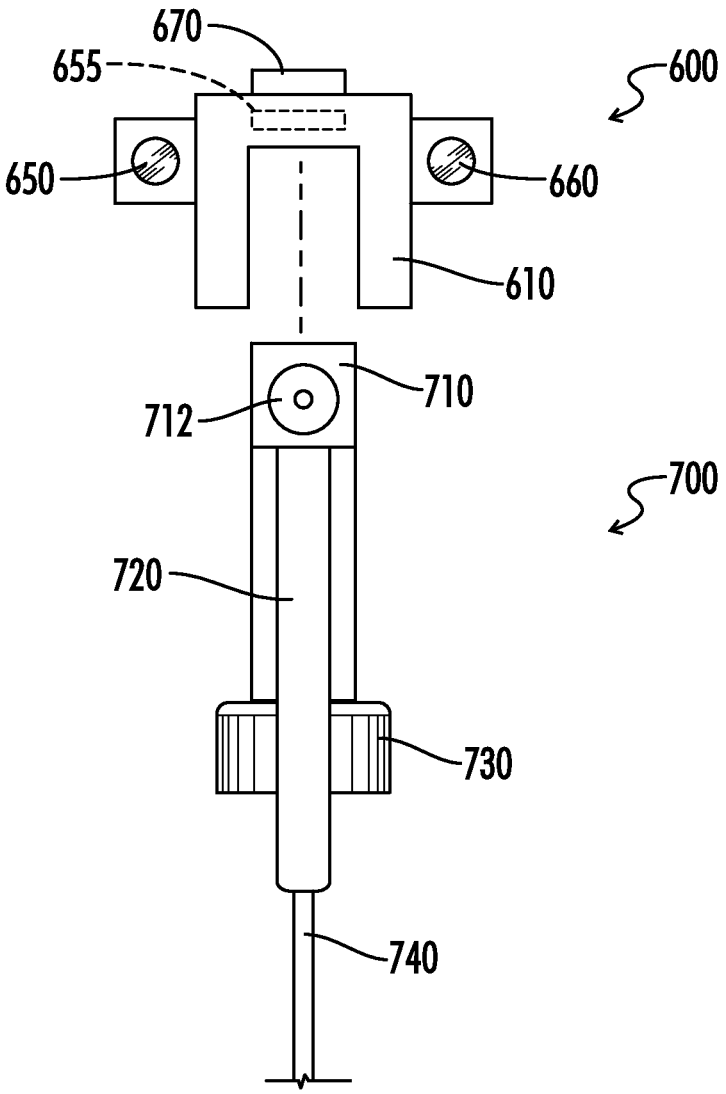
FIG. 5 illustrates a front view of an alternate embodiment of an illumination device applied to a dispenser nozzle.
Figure 6:
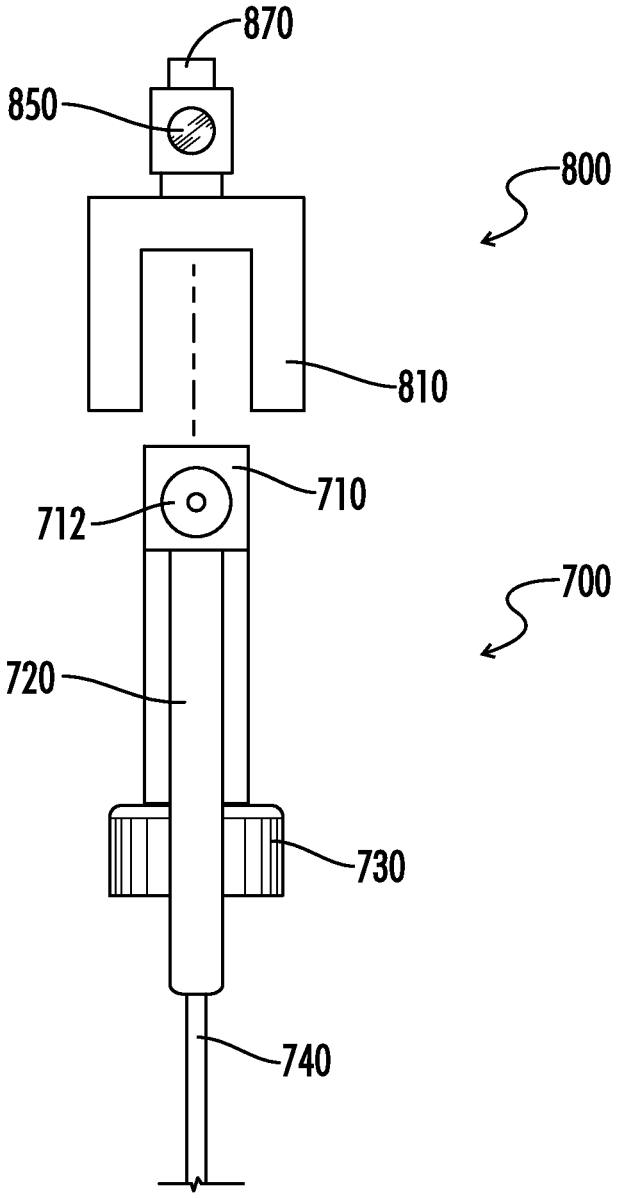
FIG. 6 illustrates a front view of an alternate embodiment of an illumination device applied to a dispenser nozzle.

The embodiments of FIGS. 1-4 illustrate the use of lights integrally incorporated into the body of a nozzle head. The embodiments of FIGS. 5 and 6 illustrate alternative embodiments showing a retrofit illumination device that is clipped to the body of a nozzle head that functions similar to the lights of FIGS. 1-4. In the embodiment of FIG. 5, a clip 610 including first and second lights 650 and 660 powered by a power source 655, such a battery for example, and controlled by a switch 670, is arranged to be attached to the body 710 of a nozzle 700 including a dispensing outlet 712, trigger 720, collar 730 and tube 740. The switch 670 of FIG. 5 may operate in an equivalent fashion as the switch 270 of FIGS. 1-3, and the lights 650 and 660 of FIG. 5 may operate similar to the lights 250 and 260 of FIGS. 1-3. The clip 610 may be attached and removed from the nozzle 700 as desired and may be used with a variety of dispensers (not shown) as desired. In the alternate embodiment of FIG. 6, a clip 810 including a light 850 powered by a power source (not shown), such a battery for example, and controlled by a switch 870, is arranged to be attached to the body 710 of a nozzle 700 including a dispensing outlet 712, trigger 720, collar 730 and tube 740. The switch 870 of FIG. 6 may operate in an equivalent fashion as the switch 570 of FIG. 4, and the light 850 of FIG. 6 may operate similar to the light 550 of FIG. 4. The clip 810 may be attached and removed from the nozzle 700 as desired and may be used with a variety of dispensers (not shown) as desired.

Figure 7:
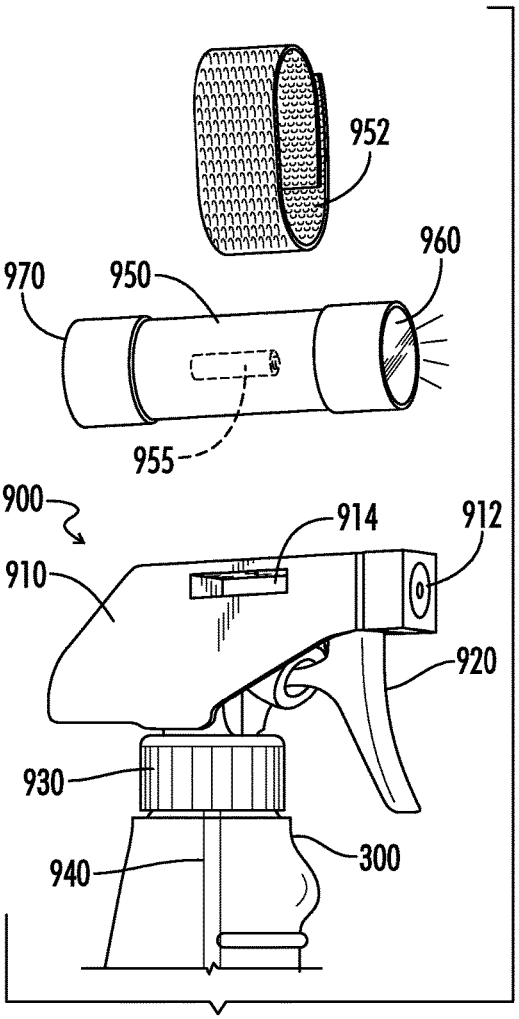
FIG. 7 illustrates an exploded view and FIG. 8 illustrates an assembled view of an alternative embodiment of a dispenser nozzle with an illumination device and fastener.
Figure 8:
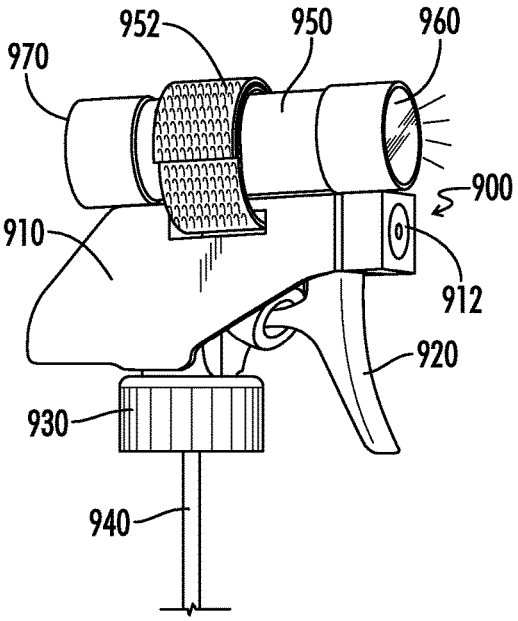

The embodiments of FIGS. 7 and 8 illustrate an alternative embodiment showing a retrofit illumination device 950, such as a mini flashlight for example, that is removably secured to the body 910 of a nozzle head 900 with a fastener 952 such as a Velcro® strap or the like, the nozzle 900 including a dispensing outlet 912, trigger 920, collar 930 and tube 940 for withdrawing cleaner 400 (FIG. 1) from a dispenser container 300. The fastener 952 may extend through a passage 914 in the body 910 of the nozzle head 900 in order to secure the illumination device 950 to the nozzle head 900 as shown, for example, in FIG. 8. Other attachment scenarios are possible, such as, for example, if the nozzle body 910 was not provided with a passage 914 and the fastener 952 was used to fasten the illumination device 950 around the width of the nozzle body 910. Alternatively, the passage 914 may be provided in a location other than that shown in the figures. The illumination device 950 may further comprise a light 960 of one or more colors, such as white light or other than white light, such as a black light or a UV light, that is powered by a power source 955, such a battery for example, and controlled by a switch 970 that can function to turn the light 960 on or off as well as change the color of the light 960 if the device 950 is adapted to illuminate in more than one color. In addition to one or more colors, the light 960 could also be adapted to shine with one or more intensities, or a combination of color and intensity. Varying other light characteristics are possible.

The ability of the illumination device 950 to be removably attached to the nozzle body 910 allows a user to separate the illumination device 950 from the nozzle body 910 and acquire a target area to be cleaned with one hand holding the illumination device 950, while holding the nozzle 910 and dispensing cleaner 400 (FIG. 1) to the target area (not shown) with the other hand. Alternatively, the illumination device 950 may be attached to the nozzle body 910 and used to acquire a target area while remaining attached to the nozzle body 910. As discussed previously, the light 960 may be switched to a black light or UV light, for example, while acquiring a target area to be cleaned, and then the light 960 may be switched to a white light while the user is applying cleaner 400 to the target area. Other lighting and cleaning scenarios are possible. The illumination device 950 may be pre-attached to the nozzle body 910 or provided therewith at the time of purchase, or it may be a pre-existing illumination device already in the possession of the user.

Figure 9:
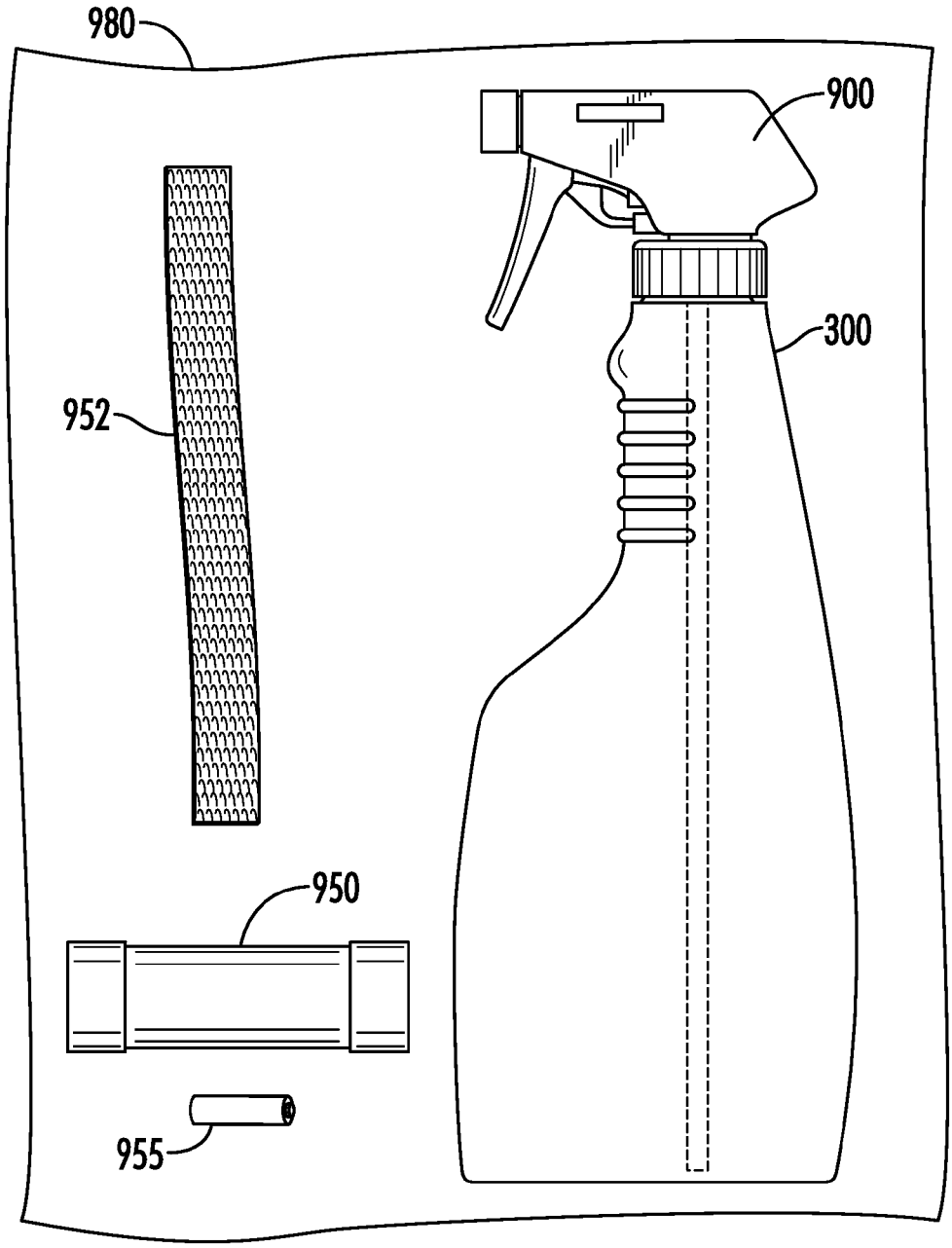
FIG. 9 illustrates one embodiment of a kit including a dispenser, illumination device and fastener.

FIG. 9 illustrates one embodiment of a kit 980 or a package including a container 300 with an attached nozzle 900, a fastener 952, an illumination device 950 and a power source 955. The container 300 may contain a cleaning fluid if desired. The power source 955 may also already be included in the illumination device 950 if desired. While a container 300 is shown, it will be appreciated that a kit may be provided without a container if the nozzle 900 may be universally adapted to attach to a variety of containers. In addition, while an illumination device 950 is shown, it will be appreciated that a kit may be provided without including an illumination device that is intended to be supplied by the user. Other combinations or sub-combinations of elements are possible.

Figure 10:
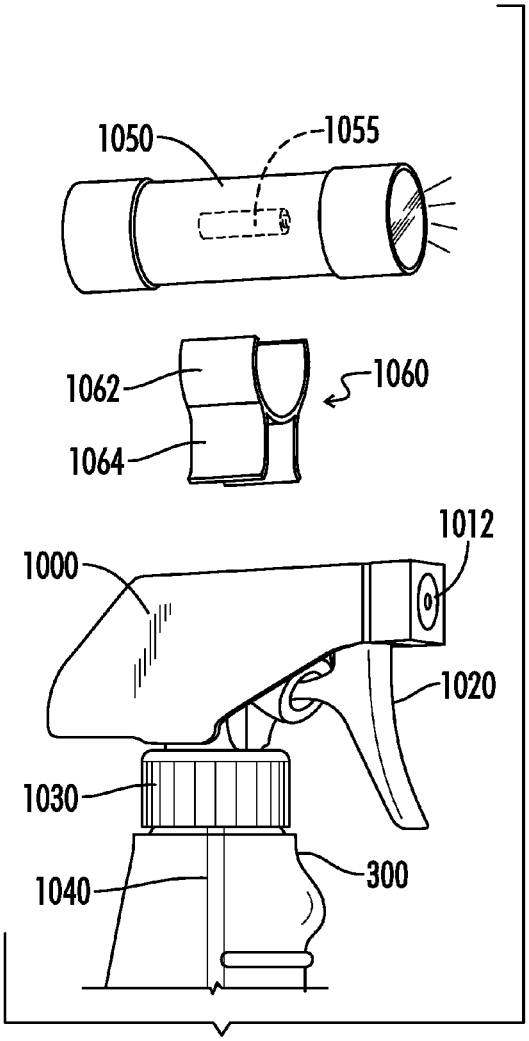
FIG. 10 illustrates an exploded view and FIG. 11 illustrates an assembled view of an alternative embodiment of a dispenser nozzle with an illumination device and fastener.
Figure 11:
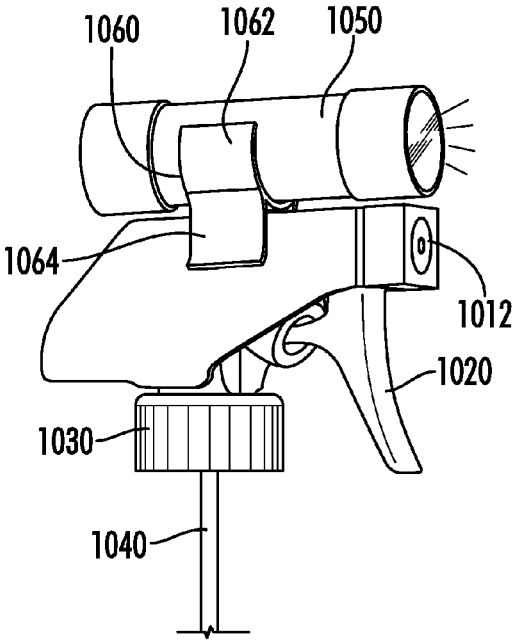
Figure 12:
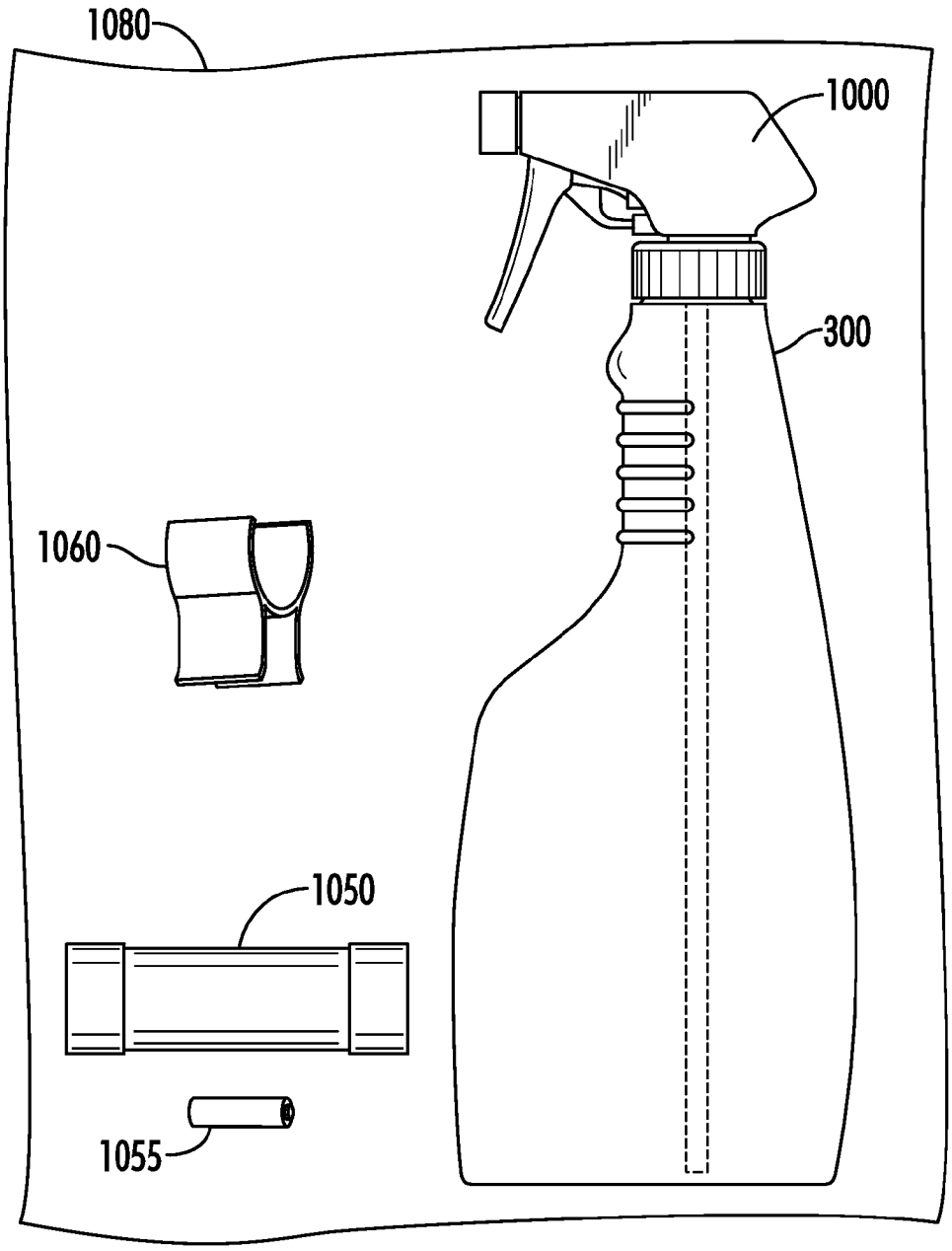
FIG. 12 illustrates an alternative embodiment of a kit including a dispenser, illumination device and fastener.

FIGS. 10 through 12 illustrate an alternative embodiment showing an illumination device 1050 powered by a power source 1055 that is removably attached to a nozzle 1000 by a clip 1060, the nozzle 1000 including a dispensing outlet 1012, trigger 1020, collar 1030 and tube 1040 for withdrawing cleaner (not shown) from a dispensing container 300. For purposes of this discussion, the illumination device 1050 is similar to the illumination device 950 of FIGS. 7 through 9 and will not be discussed in detail herein. The clip 1060 further comprises a first section 1062 adapted to removably yet securely receive the illumination device 1050 and a second section 1064 adapted to removably yet securely engage the nozzle 1000. The first section 1062 may be sufficiently resilient to accommodate illumination devices of varying dimensions, while the second section 1064 may be sufficiently resilient to engage nozzle structures of varying dimensions. In one embodiment, the first and second sections 1062, 1064 have different shapes, wherein the first section 1062 might have an arcuate profile as illustrated to accommodate a cylindrical illumination device 1050, while the second section 1064 has a parallel profile to accommodate the exterior of the nozzle 1000. Other profiles are contemplated. The clip 1060 enables engagement of the illumination device 1050 without the need for something like a passage 914 in the nozzle as shown in FIGS. 7-9. The clip 1060 may be attached and removed from the nozzle 1000 as desired and may be used with a variety of dispensers (not shown) as desired.

In an alternative embodiment, the lighting device 1050 may be provided with a clip that is pre-attached or manufactured into the body of the lighting device, such that only the equivalent of a second section 1064 is provided for attachment of the lighting device to a nozzle. Alternatively, the nozzle 1000 may be provided with a clip that is pre-attached or manufactured into the body of the nozzle, such that only the equivalent of a first section 1062 is provided for attachment of the lighting device to a nozzle.

The ability of the illumination device 1050 to be removably attached to the nozzle 1000 allows a user to separate the illumination device 1000 from the nozzle 1000 and acquire a target area to be cleaned with one hand holding the illumination device 1050, while holding the nozzle 1000 and dispensing cleaner 400 (FIG. 1) to the target area (not shown) with the other hand. Alternatively, the illumination device 1050 may be attached to the nozzle 1000 and used to acquire a target area while remaining attached to the nozzle 1000 as shown in FIG. 11. As discussed previously, the illumination device 1050 may be switched to a black light, for example, while acquiring a target area to be cleaned, and then to a white light while the user is applying cleaner to the target area. Other lighting and cleaning scenarios are possible. The illumination device 1050 may be pre-attached to the nozzle 1000 or provided therewith at the time of purchase, or it may be a pre-existing illumination device already in the possession of the user.

FIG. 12 illustrates one embodiment of a kit 1080 or a package including a container 300 with an attached nozzle 1000, a clip 1060, an illumination device 1050 and a power source 1055. The container 300 may contain a cleaning fluid if desired. The power source 1055 may also already be included in the illumination device 1050 if desired. While a container 300 is shown, it will be appreciated that a kit may be provided without a container if the nozzle 1000 may be universally adapted to attach to a variety of containers. In addition, while an illumination device 1050 is shown, it will be appreciated that a kit may be provided without including an illumination device that is intended to be supplied by the user. In addition, it will be appreciated that a kit may be provided with only an illumination device 1050 and clip 1060, which could then be used with any type of container and attached to any type of nozzle. Other combinations or sub-combinations of elements are possible.

It will be appreciated that the light features of the present disclosure may be used with a variety of dispensers activated by a variety of means, and not only the squeeze-activated trigger dispensers disclosed therein. For example, the light features can be incorporated into or attached to finger-operated push dispensers, aerosol-type dispensers, pump-actuated canister-type dispensers and the like.

All examples and conditional language recited herein are intended for pedagogical purposes to aid the reader in understanding the principles of the invention and the concepts contributed by the inventor to furthering the art, and are to be construed as being without limitation to such specifically recited examples and conditions. Moreover, all statements herein reciting principles, aspects, and embodiments of the invention, as well as specific examples thereof, are intended to encompass both structural and functional equivalents thereof. Additionally, it is intended that such equivalents include both currently known equivalents as well as equivalents developed in the future, i.e., any elements developed that perform the same function, regardless of structure.

While the present invention has been described at some length and with some particularity with respect to the several described embodiments, it is not intended that it should be limited to any such particulars or embodiments or any particular embodiment, but it is to be construed with references to the appended claims so as to provide the broadest possible interpretation of such claims in view of the prior art and, therefore, to effectively encompass the intended scope of the invention. Furthermore, the foregoing describes the invention in terms of embodiments foreseen by the inventor for which an enabling description was available, notwithstanding that insubstantial modifications of the invention, not presently foreseen, may nonetheless represent equivalents thereto.

What is claimed is:

1. A nozzle comprising a first light and a second light, wherein the first light is a white light and the second light is an ultraviolet light, wherein the first and second lights are disposed in a clip that is removably attachable to a nozzle housing, and wherein the clip further comprises a fork for straddling the nozzle housing and securing the illumination device to the nozzle housing such that said fork is the only component securing the clip to the nozzle housing.

2. The nozzle of claim 1, wherein the nozzle further comprises a body and the first and second lights are integral with the body.

3. The nozzle of claim 1, further comprising a switch for activating the first light and the second light.

4. The nozzle of claim 3, wherein the switch is a unitary slide switch that activates the first light in a first position and the second light in a second position.

5. The nozzle of claim 3, further comprising a first switch for the first light and a second switch for the second light.

6. The nozzle of claim 1, where the first and second lights are contained within a single body.

7. The nozzle of claim 1, wherein the first light is spaced from the second light.

8. The nozzle of claim 1, further comprising a squeeze trigger, and wherein activation of the trigger activates at least one of the first and second lights.

9. The nozzle of claim 8, wherein activation further comprises a partial activation and a full activation, and wherein one of the first and second lights is activated during partial activation of the squeeze trigger.

10. The nozzle of claim 1, wherein the clip further comprises a power source and a switch.

11. The nozzle of claim 10, wherein the first and second lights are incorporated in a single housing.

12. An illumination device comprising a clip having a first light and a second light, wherein the first light is a white light and the second light is an ultraviolet light, wherein the clip further comprises a fork for straddling a nozzle and securing the illumination device to the nozzle such that said fork is the only component securing the clip to the nozzle.

13. The illuminating device of claim 12, further comprising a switch for activating the first light and the second light.

14. The illuminating device of claim 13, wherein the switch is a unitary slide switch that activates the first light in a first position and the second light in a second position.

15. The illuminating device of claim 13, further comprising a first switch for the first light and a second switch for the second light.

16. The illuminating device of claim 12, where the first and second lights are contained within a single body.

17. The illuminating device of claim 12, wherein the first light is spaced from the second light.

* * * * *